US008800214B2

(12) United States Patent
Silberman et al.

(10) Patent No.: US 8,800,214 B2
(45) Date of Patent: Aug. 12, 2014

(54) AUTOMATED COVERING SYSTEM

(75) Inventors: Cyril Silberman, Miami Beach, FL (US); Barton L. Riberich, Brooklyn Park, MN (US); Francisco Pantano-Rubino, Plymouth, MN (US); Michael Becker, New Hope, MN (US); John Lanari, Maple Grove, MN (US); Peter Fervoy, St. Paul, MN (US); Justin Waldron, Golden Valley, MN (US); Timothy J. Kline, Minnetonka, MN (US); Jamie Siegrist, Minneapolis, MN (US); Alex Krueger, Richfield, MN (US); Robert Doherty, Eden Prairie, MN (US)

(73) Assignee: Uni-Systems, LLC, Minneapolis, MN (US)

( * ) Notice: Subject to any disclaimer, the term of this patent is extended or adjusted under 35 U.S.C. 154(b) by 0 days.

(21) Appl. No.: 13/229,846

(22) Filed: Sep. 12, 2011

(65) Prior Publication Data

US 2012/0279140 A1 Nov. 8, 2012

Related U.S. Application Data

(60) Provisional application No. 61/483,262, filed on May 6, 2011.

(51) Int. Cl.
*E04B 1/346* (2006.01)
*E04B 7/16* (2006.01)

(52) U.S. Cl.
USPC ..... 52/64; 52/66; 52/72; 52/108; 160/67; 160/61; 160/72

(58) Field of Classification Search
USPC ..... 52/6, 64, 66, 68, 72, 108; 472/92; 242/390.6; 160/61, 67, 68, 66, 69, 72, 160/262; 135/129, 117, 123, 903
See application file for complete search history.

(56) References Cited

U.S. PATENT DOCUMENTS

| | | | | |
|---|---|---|---|---|
| 3,465,483 | A * | 9/1969 | Miller | 52/72 |
| 3,510,996 | A * | 5/1970 | Popil | 52/64 |
| 3,690,080 | A * | 9/1972 | Dillard | 52/108 |
| 3,847,112 | A * | 11/1974 | Wise | 118/705 |
| 4,636,579 | A * | 1/1987 | Hanak et al. | 136/245 |
| 5,433,259 | A * | 7/1995 | Faludy | 160/67 |
| 6,360,492 | B1 | 3/2002 | Ross | |
| 7,472,739 | B2 | 1/2009 | Heidenreich | |
| 7,576,282 | B2 * | 8/2009 | Heidenreich | 136/244 |
| 7,806,370 | B2 * | 10/2010 | Beidleman et al. | 244/172.7 |
| 8,066,277 | B2 * | 11/2011 | Ubayashi | 271/171 |
| 8,109,472 | B1 * | 2/2012 | Keller et al. | 244/172.7 |
| 2006/0005473 | A1 | 1/2006 | Friedman | |

* cited by examiner

*Primary Examiner* — Chi Q Nguyen
(74) *Attorney, Agent, or Firm* — The Patentwise Group, LLC

(57) ABSTRACT

A covering system includes a flexible, web-like membrane having first and second portions. A first cross support is connected to the first portion of the membrane, and a second cross support is connected to the second portion of the membrane. A drive mechanism is provided for moving the second cross support relative to the first cross support so that the membrane is movable between a first, retracted position and a second, deployed position. The drive mechanism includes a force multiplication mechanism for facilitating a longitudinal tensile stress application to the membrane when it is in the second, deployed position. A transverse tensioning mechanism that includes a catenary linkage is also provided for tensioning the membrane in a direction that is transverse to the longitudinal direction.

26 Claims, 11 Drawing Sheets

AUTOMATED COVERING SYSTEM

Priority under 35 U.S.C. §119(e) is claimed to U.S. Provisional Patent Application Ser. No. 61/483,262, filed May 6, 2011, the entire disclosure of which is hereby incorporated by reference as if set forth fully herein.

BACKGROUND OF THE INVENTION

1. Field of the Invention

This invention relates generally to structures and systems that are designed to selectively shelter or cover a surface or a space. Without limitation, such a system or structure may be embodied as a roof, a partition, a wall panel, façade, shade or awning. The invention is particularly suitable for large outdoor sheltering or covering systems.

2. Description of the Related Technology

The concept of a structure or system for selectively covering a surface or a space has been known since time immemorial, and is embodied in structures as varied as household window shades and awnings to retractable covers for stadiums and manufacturing facilities. A covering system may be designed for indoor use or for outdoor use, and may include a solid sheltering surface, a flexible sheltering surface such as a fabric material or a combination of such elements.

A covering system that utilizes a flexible sheltering surface such as a fabric material tends to possess advantages over a system that has a solid sheltering surface, such as reduced fabrication costs, reduced weight and the ability to require less space when it is not being deployed. However, a number of technical problems have made it difficult to deploy large, outdoor covering systems that utilize a flexible sheltering surface such as a fabric material. For purposes of this document, a large outdoor covering system is a system that has a sheltering surface that is at least substantially 500 ft.$^2$. Such large covering systems present technical and engineering design challenges that do not exist in smaller covering systems. Accordingly, engineering solutions that have been successfully applied to smaller systems are not necessarily transferable to large covering systems.

For example, strong winds can cause an outdoor fabric covering system to become unstable, particularly if the fabric material is not adequately tensioned. Heavy snow can also cause the fabric material to sag or tear if the fabric material is not adequately supported and tensioned. While motorized systems for deploying a fabric covering system exist, the force requirements for adequately tensioning a large fabric covering system would have required a drive mechanism so robust and bulky that the system would have been uneconomical and unwieldy. Moreover, the typical motorized deployment system for a fabric covering system is not capable of tensioning the fabric cover in more than one direction.

A need exists for a large outdoor flexible covering system that is economical to construct and deploy, that provides superior weather resistance and that is capable of tensioning the flexible sheltering surface in more than one direction.

SUMMARY OF THE INVENTION

Accordingly, it is an object of the invention to provide a large outdoor flexible covering system that is economical to construct and deploy, that provides superior weather resistance and that is capable of tensioning the flexible sheltering surface in more than one direction.

In order to achieve the above and other objects of the invention, a covering system according to a first aspect of the invention includes a flexible, web-like membrane that has first and second portions, a first cross support that is connected to the first portion of the membrane and a second cross support that is connected to the second portion of the membrane. The system further includes a drive mechanism for moving the second cross support relative to the first cross support so that the membrane is movable between a first, retracted position and a second, deployed position. The drive mechanism includes a force multiplication mechanism for facilitating a stress application to the membrane when it is in the second, deployed position.

A covering system according to a second aspect of the invention includes a flexible, web-like membrane having first and second portions, a first cross support that is connected to the first portion of the membrane and a second cross support that is connected to the second portion of the membrane. The system further includes a drive mechanism for moving the second cross support relative to the first cross support so that the membrane is movable in a first direction having a longitudinal component between a first, retracted position and a second, deployed position in which the membrane is tensioned in the first direction. Moreover, the system includes a transverse tensioning mechanism that is constructed and arranged to create a tension in the web-like membrane that is substantially transverse to the first direction.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
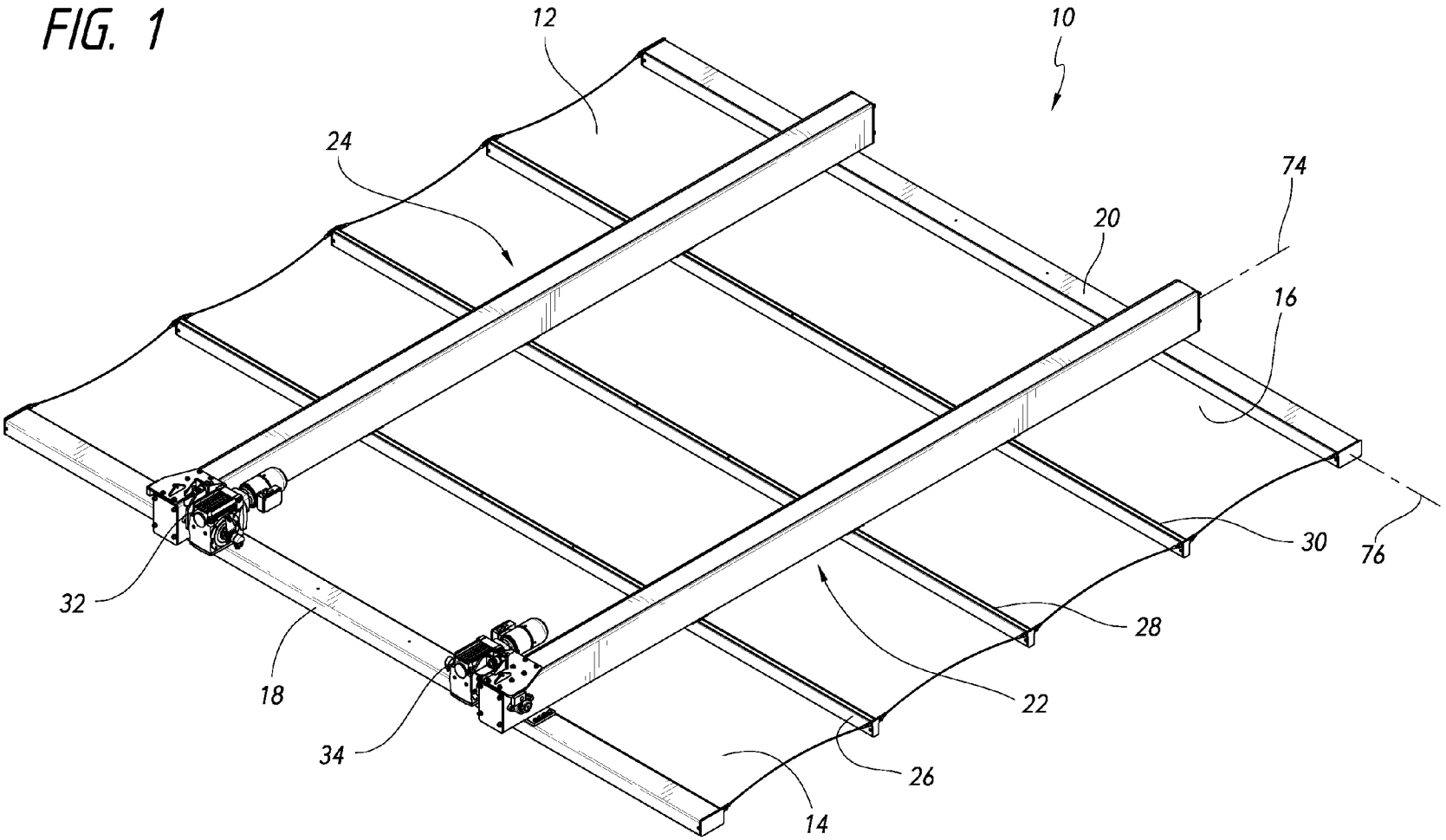
FIG. 1 is a perspective view of a covering system that is constructed according to a preferred embodiment of the invention, shown in a first operative position.

Referring now to the drawings, wherein like reference numerals designate corresponding structure throughout the views, and referring in particular to FIG. 1, a covering system 10 that is constructed according to a preferred embodiment of the invention includes a flexible, web-like membrane 12 having a first portion 14 and a second portion 16. The flexible, web-like membrane 12 is preferably fabricated from a woven fabric material such as a single ply ePTFE woven fabric. Such a material is commercially available from W. L. Gore & Associates, Inc. as SEFAR® Architecture TENARA® Fabric. This material is made of a base fabric of woven high strength expanded PTFE fibers. Alternatively, the flexible web-like membrane 12 could be fabricated from a nonwoven material, or an alternative woven material such as polyvinyl chloride (PVC).

Figure 3:
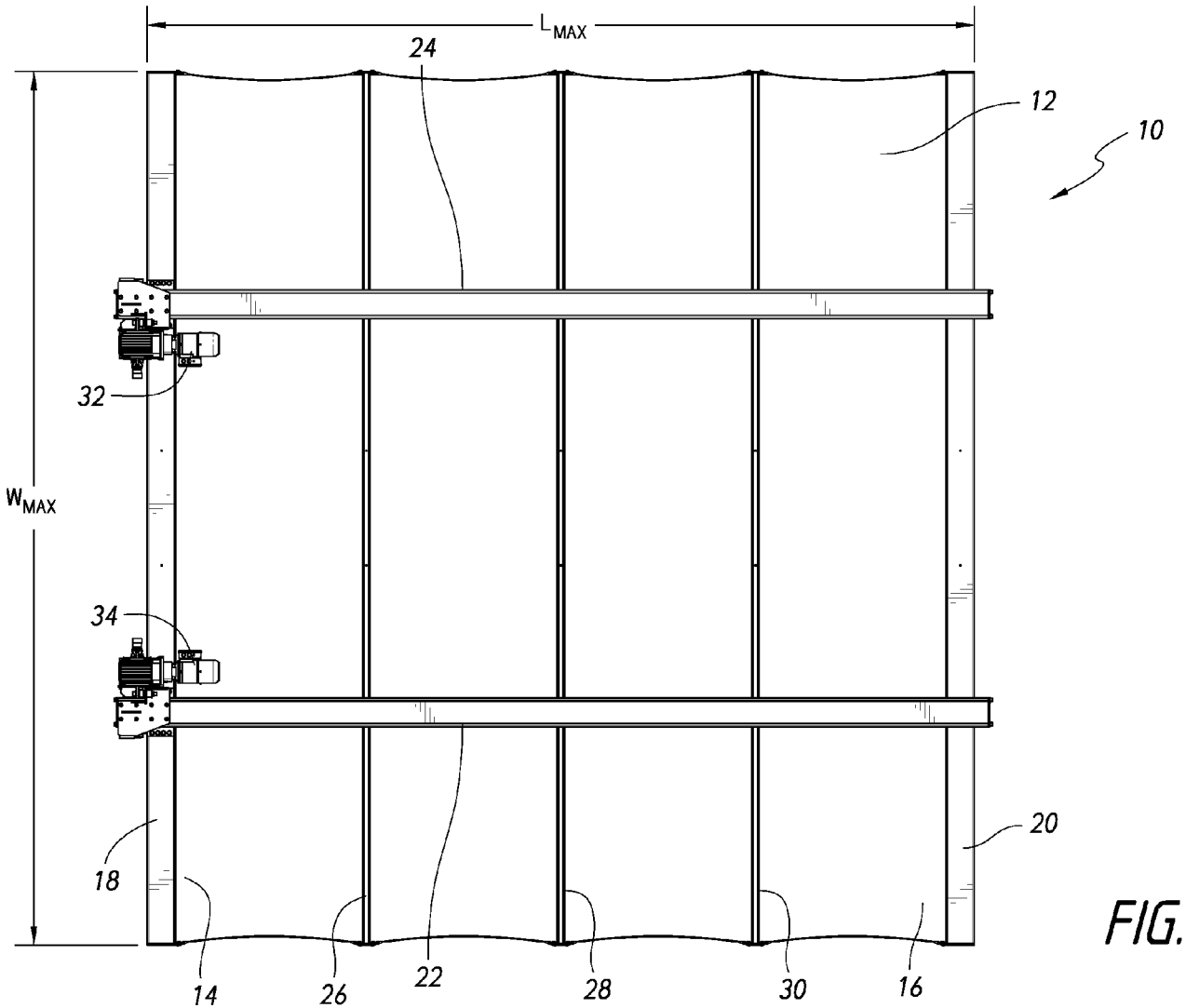
FIG. 3 is a top plan view of the covering system that is shown in FIG. 1.
Figure 4:
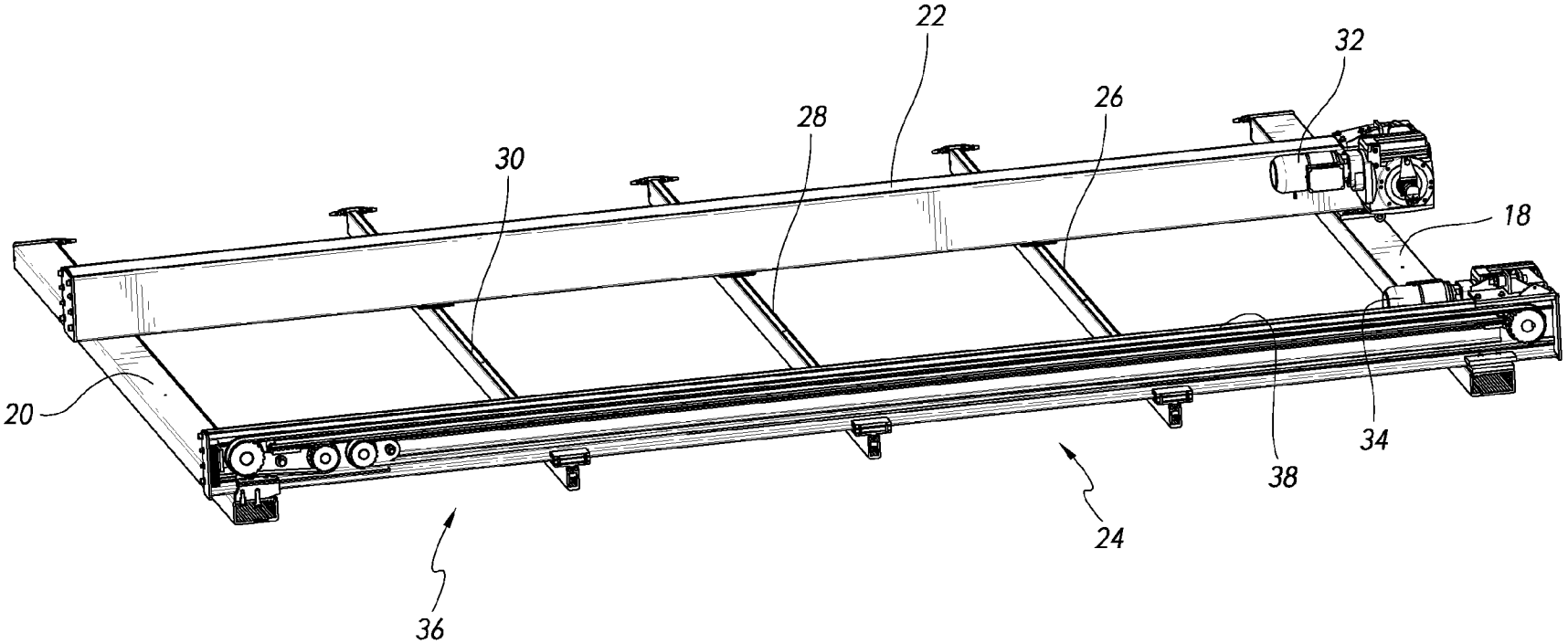
FIG. 4 is a fragmentary view of a portion of the covering system that is shown FIG. 1, depicting details of a drive mechanism.

Referring briefly to FIG. 3, it will be seen that the flexible, web-like membrane 12 is substantially rectangular in shape in the preferred embodiment, having a maximum length $L_{MAX}$ and a maximum width $W_{MAX}$ as viewed in top plan. Preferably, the web-like membrane 12 has a surface area that is substantially at least about 500 ft.$^2$ More preferably, the web-like membrane 12 has a surface area that is substantially at least about 800 ft.$^2$ Most preferably, the web-like membrane has a surface area that is substantially at least 1000 ft.$^2$.

The covering system 10 further preferably includes a first cross support 18 that is connected to the first portion 14 of the web-like membrane 12. A second cross support 20 is connected to the second portion 16 of the web-like membrane 12. The first and second cross supports 18, 20 in the preferred embodiment are substantially linear and fabricated from a lightweight metallic material such as aluminum. Preferably, the first and second cross supports 18, 20 are constructed so as to be resistant to bending stresses. As may be seen in FIG. 5, in the preferred embodiment the first and second cross supports 18, 20 are fabricated as a hollow aluminum tube having a space defined therein and having a substantially rectangular cross-section.

Alternatively, the first and second cross supports 18, 20 could have a shape other than a substantially linear shape, such as a curved shape.

Figure 2:
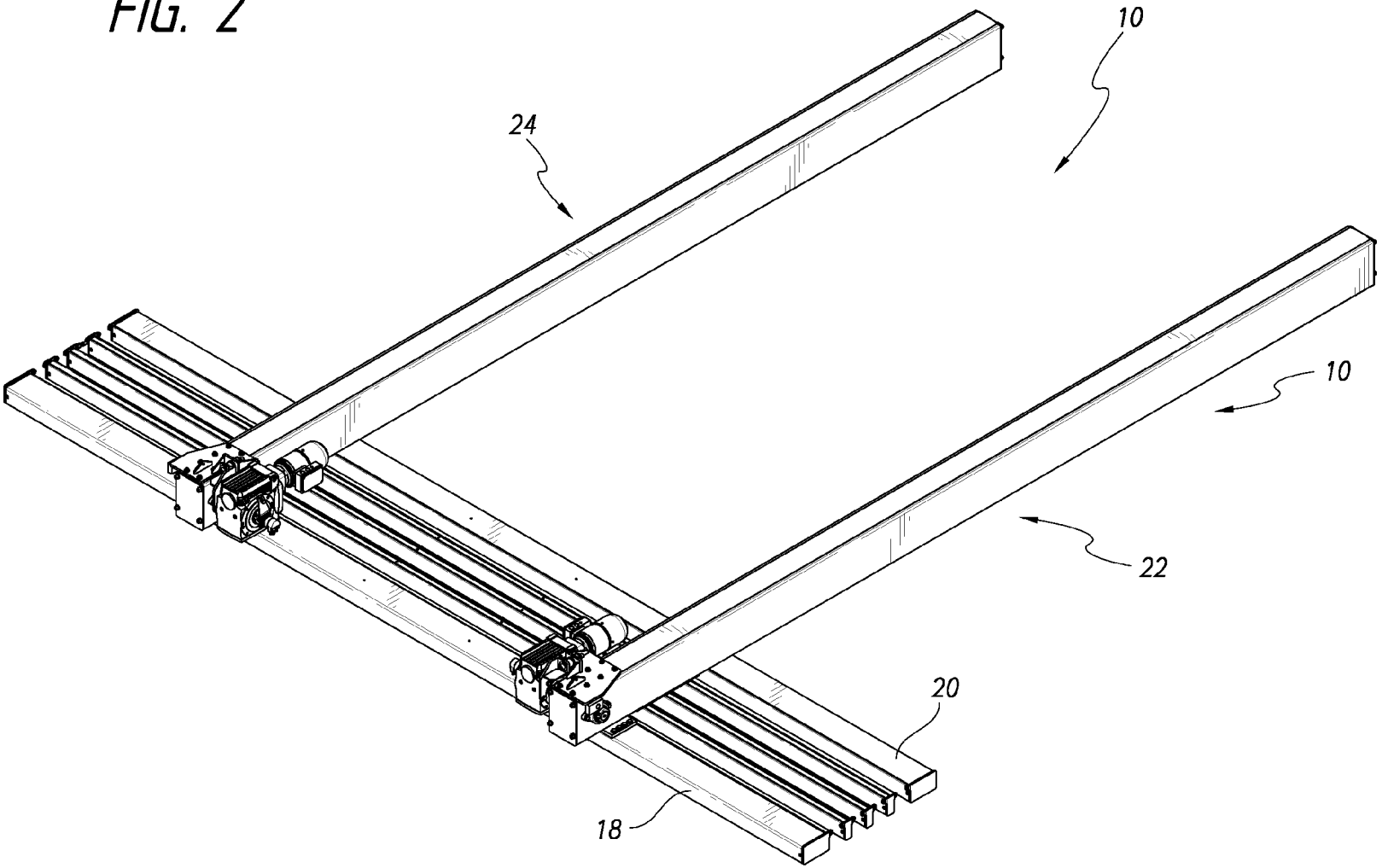
FIG. 2 is a perspective view of the covering system that is shown in FIG. 1, shown in a second operative position.

Covering system 10 further includes a drive mechanism for moving the second cross support 20 relative to the first cross support 18 so that the flexible, web-like membrane 12 is movable between a first, retracted position that is depicted in FIG. 2 and a second, deployed position that is depicted in FIG. 1. As is shown in FIG. 1, the drive mechanism preferably includes a first drive mechanism 22 and a second drive mechanism 24. As will be described in greater detail below, both the first drive mechanism 22 and the second drive mechanism 24 advantageously include a force multiplication mechanism 36 for facilitating a stress application to the flexible, web-like membrane 12 in the final stages of its deployment to the second position that is shown in FIG. 1.

In the preferred embodiment, covering system 10 further includes a third cross support member 26, a fourth cross support member 28 and a fifth cross support member 30. The cross support members 18, 20, 26, 28 and 30 are preferably substantially linear in shape and substantially parallel to each other.

The second and first drive mechanisms 24, 22 respectively are provided with an electric motor 32, 34. Each of the first and second drive mechanisms 24, 22 preferably includes a an elongated drive beam 38 that is substantially linear and oriented parallel to a longitudinal axis 74, shown in FIG. 1. The cross support members 18, 20, 26, 28 and 30 are oriented so that they are substantially parallel to a transverse axis 76, also shown FIG. 1, that is substantially perpendicular to the longitudinal axis 74. The flexible, web-like membrane 12 is moved by the first and second drive mechanisms 24, 22 in a direction that is substantially parallel to the longitudinal axis 74 when it is moved from the first, open position to the second, deployed position.

Alternatively, the first and second drive mechanisms 24, 22 could be constructed so that they have a nonlinear shape, for example a curved shape. Cross supports 18, 20, 26, 28 and 30 could also be constructed so that their axis is not completely perpendicular to axis 74, nor are they required to be completely parallel with each other.

The force multiplication mechanism 36 is best shown in FIGS. 4-7. Each of the drive mechanisms 24, 22 preferably includes a transmission gear assembly 40 that couples a drive shaft of the respective electric motor 32, 34 to an output shaft 44 that extends through an outer casing 39 of the elongated drive beam 38 into an interior space 41 within the elongated drive beam 38. The output shaft 44 is keyed to a first pulley 42 that has a circumferential surface that preferably includes a plurality of teeth 43.

Figure 5:
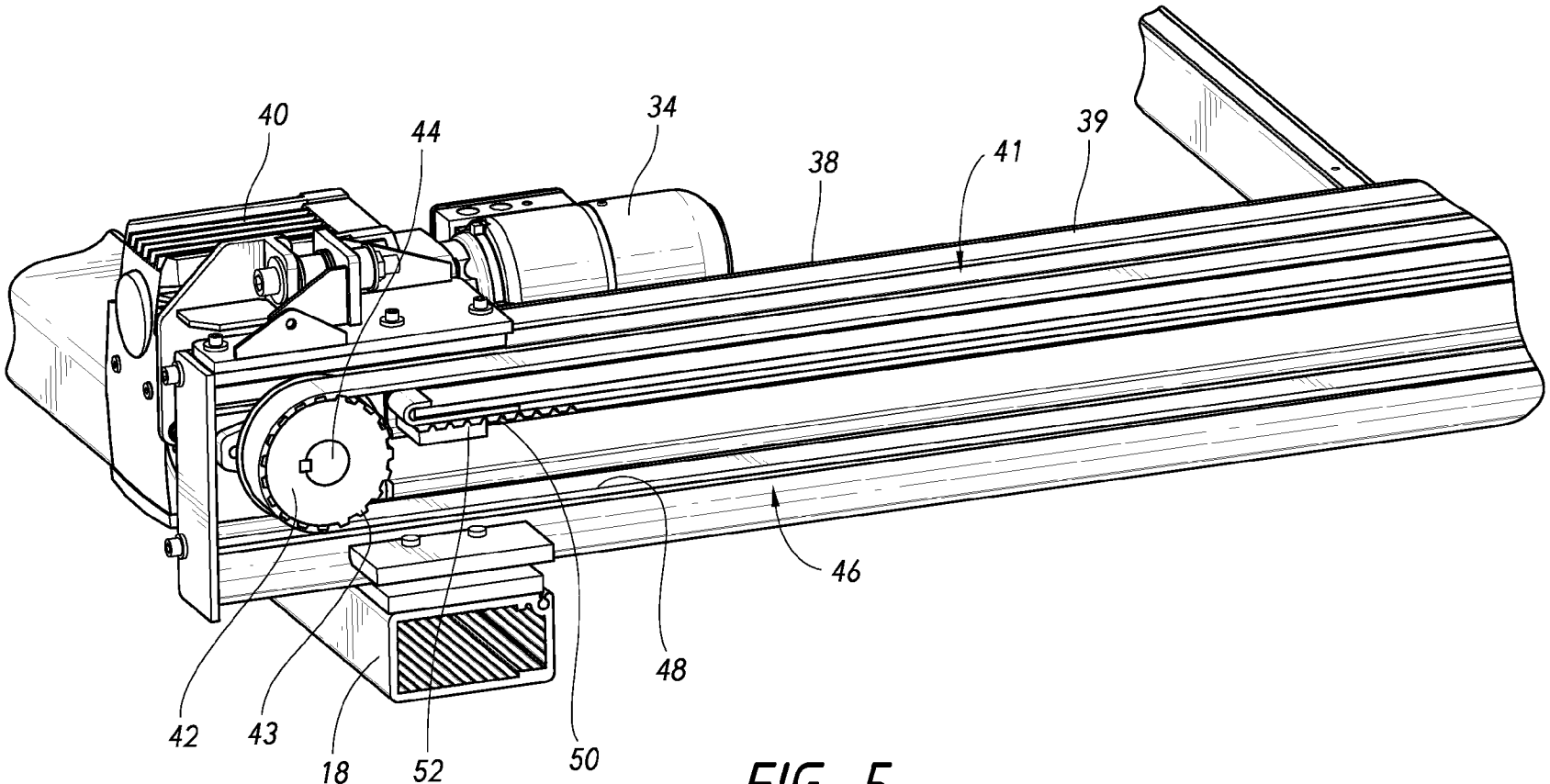
FIG. 5 is a fragmentary view of a portion of the drive mechanism that is shown FIG. 4, with the covering system being depicted in a second, deployed position.

The force multiplication mechanism 36 preferably utilizes a flexible drive member 46, which in the preferred embodiment is a toothed belt 48 that is engaged with and driven by the first pulley 42. As FIG. 5 shows, the toothed belt 48 has a first end 50 that is secured to the elongated drive beam 38 by means of a clamp 52. The clamp 52 preferably includes a plurality of teeth that mate with the toothed surface of the toothed belt 48 in order to ensure securement of the belt 48 to the elongated drive beam 38.

Figure 6:
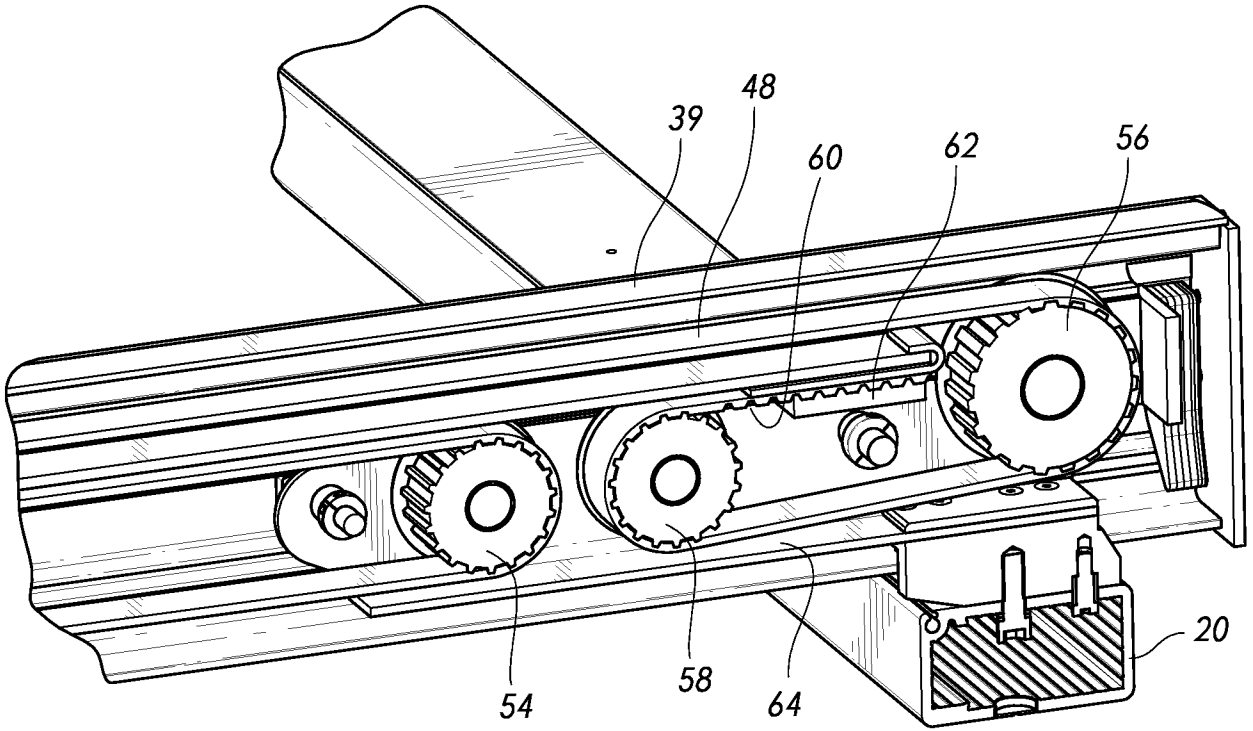
FIG. 6 is a fragmentary view of another portion of the drive mechanism that is shown FIG. 4, with the covering system being depicted in the second, deployed position.

The force multiplication mechanism 36 further includes a second idler pulley 54 that is rotatably mounted to a trolley member 64, as is best shown in FIG. 6. The trolley member 64 is preferably substantially linear in shape and is mounted for movement relative to the elongated drive beam 38 in a direction that is parallel to the longitudinal axis 74. The second cross support 20 is mounted for movement together with the trolley member 64. The first cross support 18 is secured to the elongated drive beam 38. The additional cross supports 26, 28, 30 are preferably secured to the flexible, web-like membrane 12 but not directly to either the trolley member 64 or the elongated drive beam 38. Accordingly, the additional cross supports 26, 28, 30 are moved from their retracted to their extended positions via the movement of the membrane 12.

Each of the additional cross supports 26, 28, 30 is preferably provided with a friction reducing bearing for reducing the relative friction between the cross support and the elongated drive beam 38 when being deployed in retracted. In the preferred embodiment, the friction reducing bearing is respectively constructed as an integral upper bearing plate 68, 70, 72 that is constructed to bear against the underside of the outer casing 39 of the elongated drive beam 38. The bearing plate 68, 70, 72 is preferably constructed out of a friction reducing material such as polytetrafluoroethylene PTFE).

Accordingly, the covering system 10 is moved from the open position that is shown in FIG. 2 to the second, closed, deployed position shown in FIG. 1 by extending the trolley member 64 relative to the elongated drive beam 38 by using the first and second drive mechanisms 24, 22. The force multiplication mechanism 36 is mechanically interposed between the elongated drive beam 38 and the trolley member 64.

As is best shown in FIG. 6, the force multiplication mechanism 36 further includes a third idler pulley 56 that is rotatably mounted to a distal end of the elongated drive beam 38 and a fourth idler pulley 58 that is rotatably mounted to the trolley member 64. A second end 60 of the toothed belt 48 is secured to the elongated drive beam 38 by means of a toothed clamp 62. The toothed belt 48 accordingly extends from the first end 50 in a first loop in which it extends in an outward direction and about the second pulley 54, then back in an inward direction about the first, drive pulley 42. It then extends outwardly along substantially the entire length of an upper portion of the interior space 39 of the elongated drive beam 38. The toothed belt 48 then forms a second loop in which it extends about the third, idler pulley 56, then back in an inward direction and about the fourth, idler pulley 58. The toothed belt 48 then extends back in the outward direction to its second end 60, which is secured to the elongated drive beam 38 by the second clamp 62.

Figure 7:
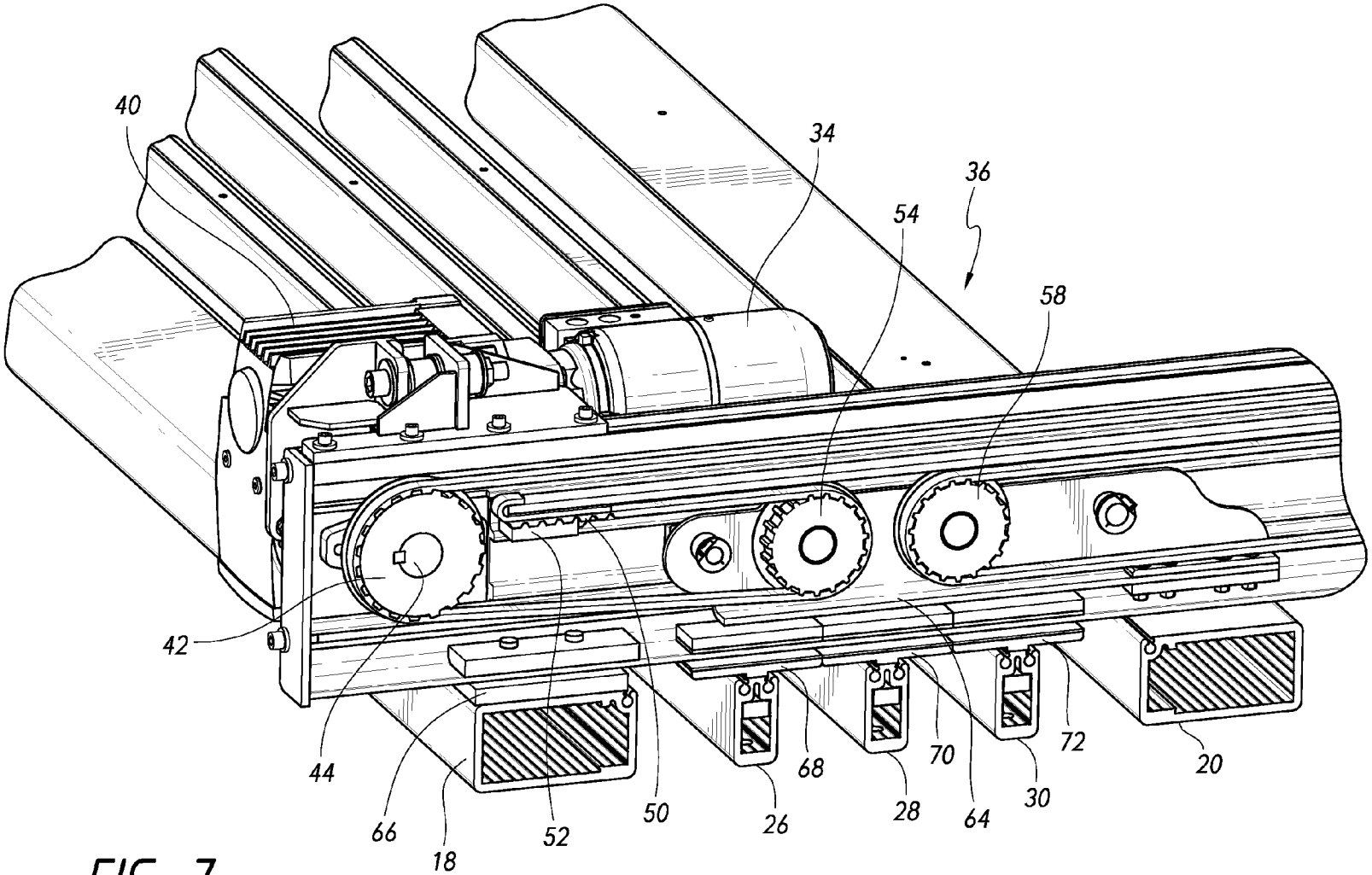
FIG. 7 is a fragmentary view of the portion of the drive mechanism that is shown in FIG. 5, with the covering system being depicted in a first, open position.

FIGS. 5 and 6 depict the covering system 10 and the force multiplication mechanism 36 when it is in the second, closed, deployed position that is shown in FIG. 1. FIG. 7 depicts the positions of the pulleys 42, 54, 58, the trolley member 64 and the cross support members 26, 28, 30, 20 when the covering system 10 is in the first, open position that is shown in FIG. 2. The double loop pulley arrangement of the force multiplication mechanism 36 has a mechanical effect of multiplying the force that is transmitted from the electric motor 32, 34, while decreasing the speed of deployment. Preferably the force multiplication ratio is substantially within a range of about 1.25-16, more preferably within a range of about 1.5-8 and most preferably substantially within a range of 1.75-4. In the preferred embodiment disclosed herein, the force multiplication ratio is about 2.0.

The system 10 is also preferably configured to include a transverse tensioning mechanism that is constructed and arranged to create a transverse tension in the membrane 12 when the membrane 12 is in the deployed position. In the preferred embodiment, the transverse tensioning mechanism 78 is configured to create the transverse tension in response to a longitudinally oriented tension in the membrane 12 that is created as a result of force that is applied to the membrane 12 by the first and second drive mechanisms 22, 24 and their respective force multiplication mechanisms 36.

Figure 8:
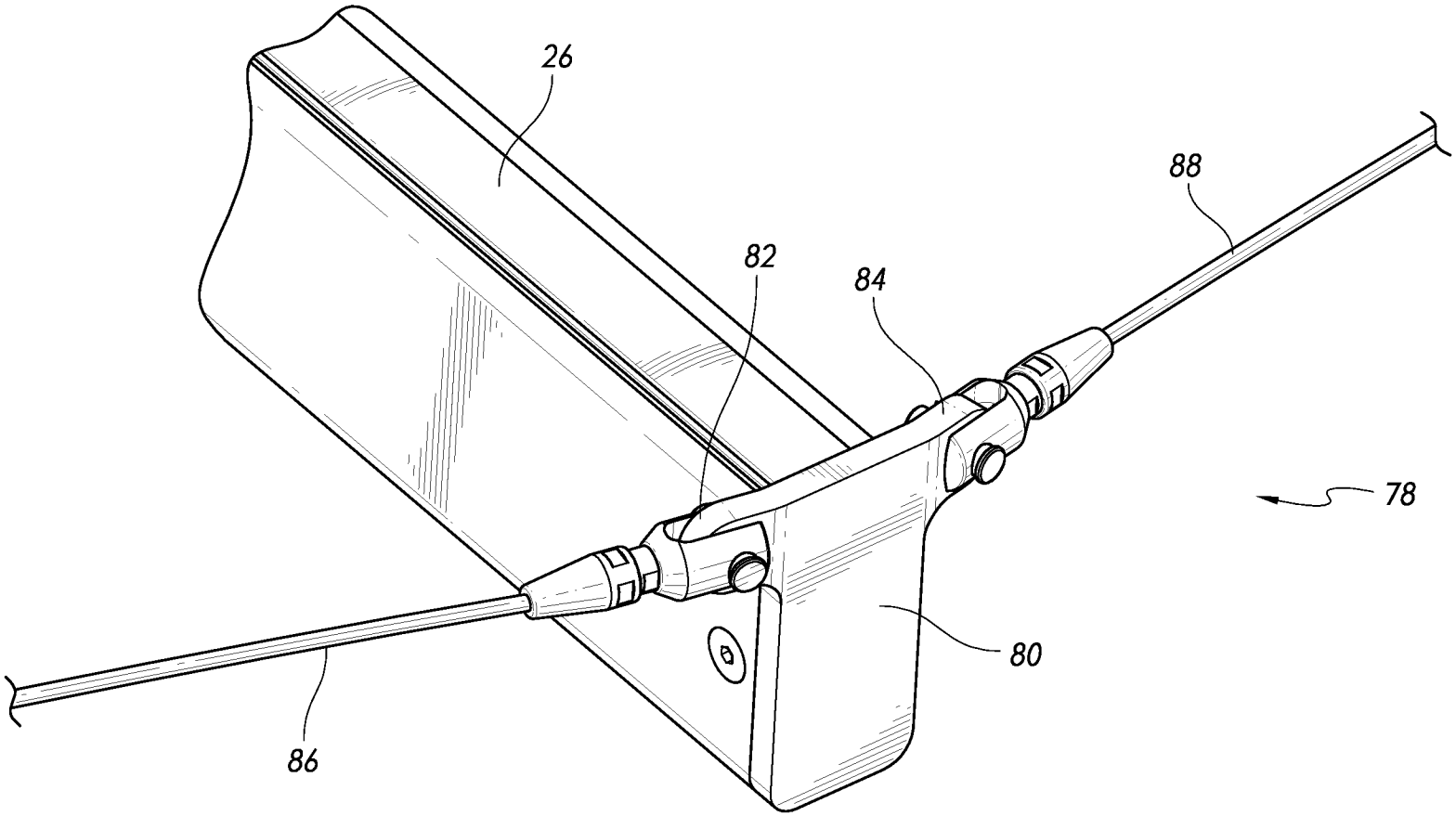
FIG. 8 is a fragmentary perspective view of a portion of the covering system that is shown in FIG. 1, depicting details of a transverse tensioning mechanism.
Figure 9:
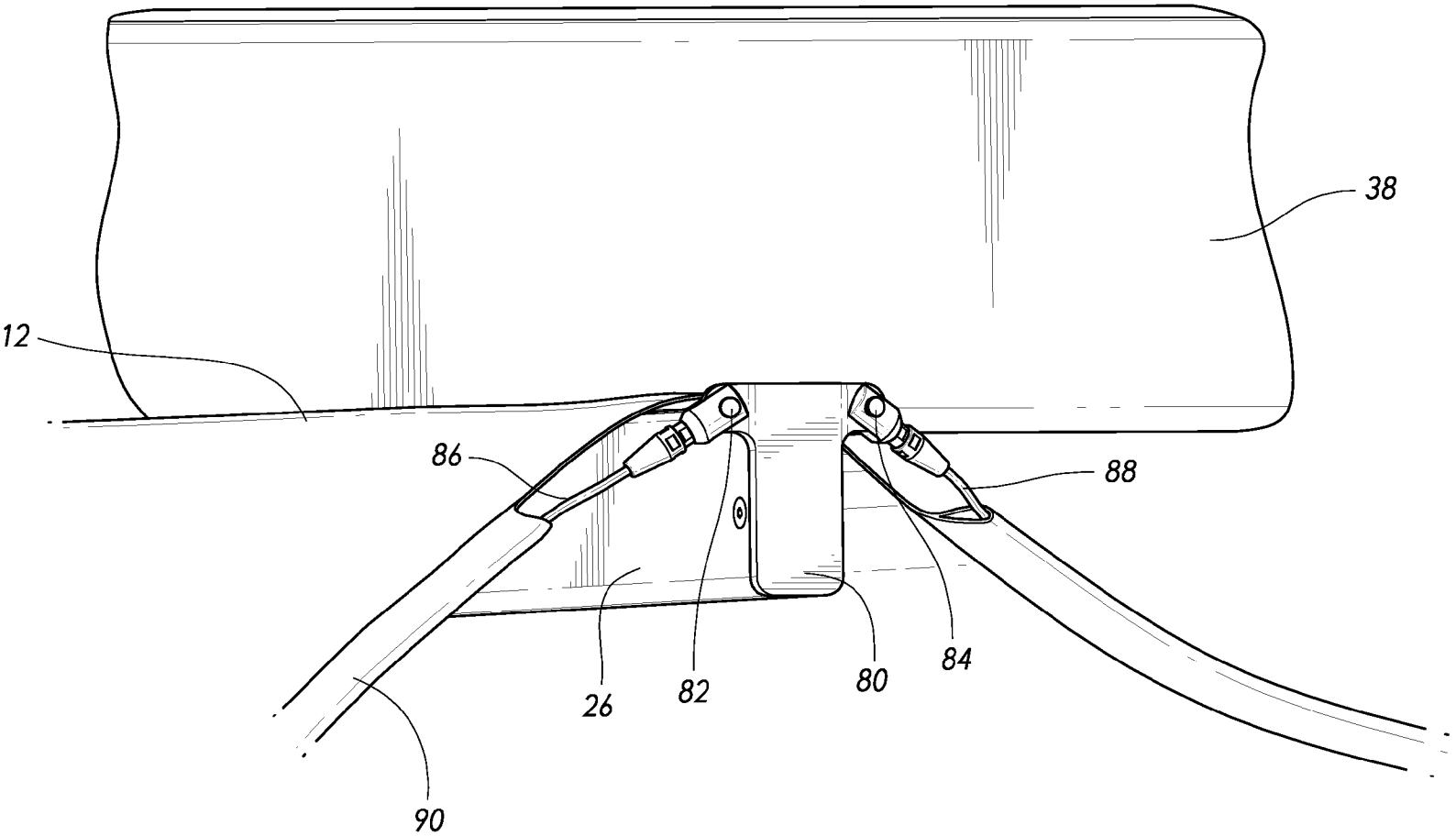
FIG. 9 is a perspective view depicting further details of the transverse tensioning mechanism that is shown in FIG. 8.

More specifically, the transverse tensioning mechanism 78 includes a plurality of catenary linkages that are positioned near the distal ends of the cross supports 18, 20, 26, 28, 30. For example, as may be seen in FIG. 8, the distal end of the cross support 26 includes a mounting bracket 80 having a first mounting portion 82 that is secured to a first catenary cable 86 and a second mounting portion 84 that is secured to a second catenary cable 88. In the preferred embodiment, each of the cross supports 18, 20, 26, 28, 30 has such a mounting bracket 80 at both of the distal ends, and a catenary cable spanning the variable gaps between the distal end in the distal end of the adjacent cross support. As FIG. 9 shows, the outermost edges of the membrane 12 in the transverse direction are secured to the catenary cables. In the preferred embodiment, the outermost edge 90 of the membrane 12 is folded over the catenary cable 86.

When the membrane 12 is longitudinally tensioned during its final positioning into the second, closed, deployed position, the catenary cables are pulled from their slack, untensioned positions to a relatively taut, tensioned position in which their radius of curvature is increased and they assume a straighter position. This has the effect of pulling the outermost edges 90 of the membrane 12 outwardly and away from each other, thereby creating a transverse tension within the membrane 12.

Figure 10:
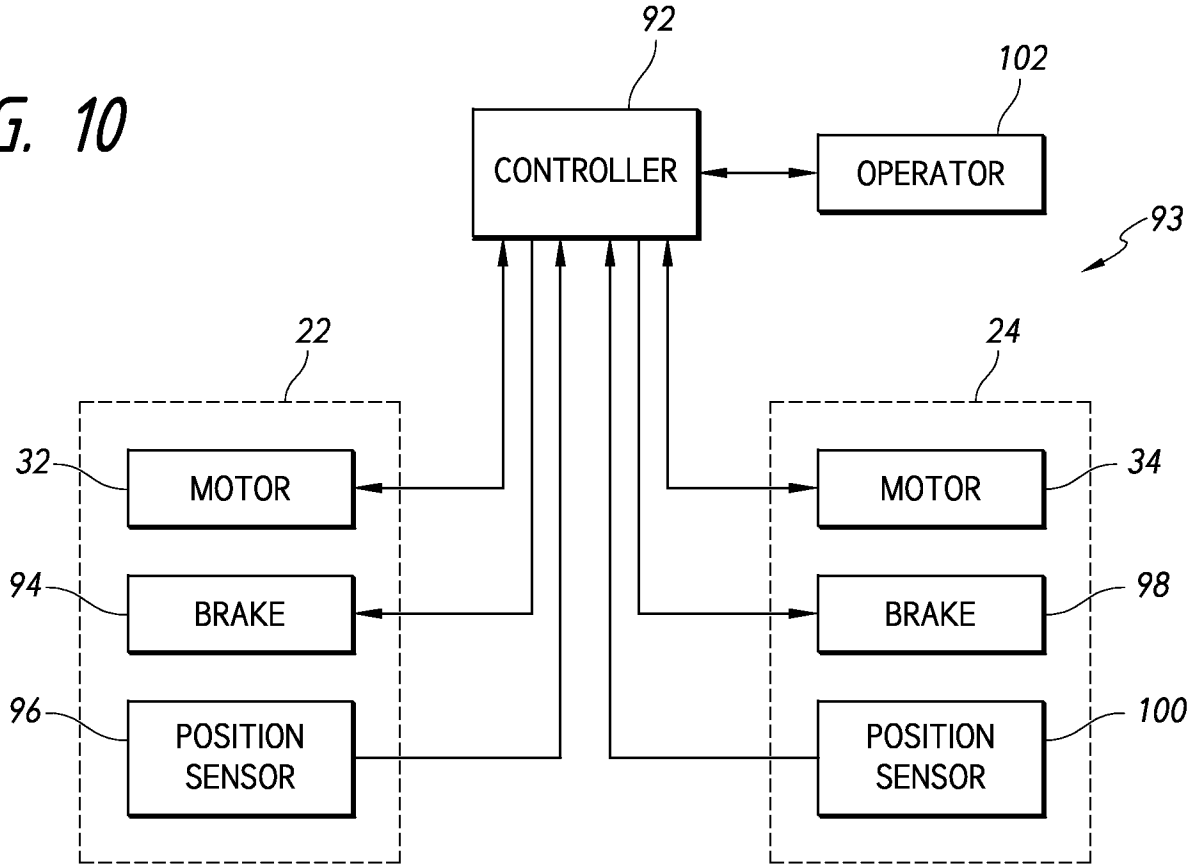
FIG. 10 is a schematic diagram depicting a control system for the covering system that is shown in FIG. 1.

The covering system 10 further includes a control system 93, which is schematically depicted in FIG. 10. The control system 93 includes a controller 92, which may include a programmable logic controller (PLC) and a variable frequency drive (VFD). The controller 92 controls deployment of the membrane 12 from the first, open position to the second, closed, deployed position by controlling operation of the first drive mechanism 22 and a second drive mechanism 24. Specifically, controller 92 is configured to provide instruction input to the electric motors 32, 34. In addition, the controller 92 is configured to receive information from the electric motors 32, 34, such as the amount of electricity that is being consumed and the amount of torque that is being generated by the electric motor 32, 34. Controller 92 also controls the application of brake mechanisms 94, 98, which secure the drive mechanisms in a locked position when in the second, deployed position. Control system 93 further is configured to receive input from position sensing instruments 96, 100 that are located on the respective drive mechanisms 22, 24. In the preferred embodiment, the position sensing instruments 96, 100 are encoders that report the positional displacement of movement of the drive train that includes the drive shaft of the electric motor 32, 34.

The control system 93 is advantageously constructed and arranged to instruct the drive mechanisms 22, 24 to implement prestressing of the membrane 12 during the final phase of positioning of the membrane 12 in the second, closed, deployed position that is shown in FIG. 1. In the preferred embodiment, the final positioning phase involves the controller 92 instructing the respective electric motors 32, 34 to reduce the longitudinal speed by which the second cross support 20 is being moved away from the first cross support 18, and simultaneously increasing the amount of torque output that is available from the electric motors 32, 34.

Figure 11:
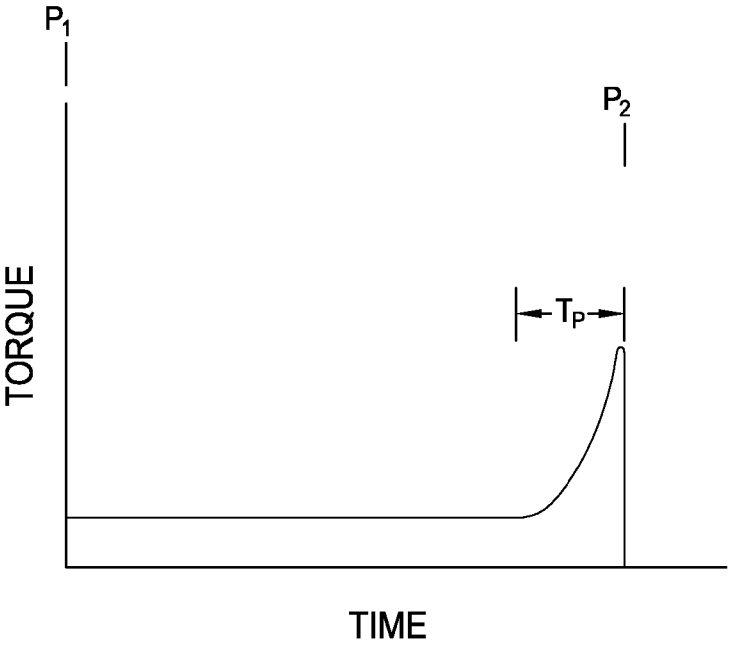
FIG. 11 is a graphical depiction of torque versus time as the covering system that is depicted in FIG. 1 is moved from the first, open position to the second, deployed position.

FIG. 11 is a graphical depiction of torque versus time, showing that the amount of torque outputted from the electric motors 32, 34 remains relatively constant during the initial phases of deployment, but is increased in the final positioning phase $T_P$ until a predetermined desired amount of pretensioning of membrane 12 is created in the final position is reached. At that point, the brake mechanisms 94, 98 are applied and no further energy output is required from the electric motors 32, 34.

Figure 12:
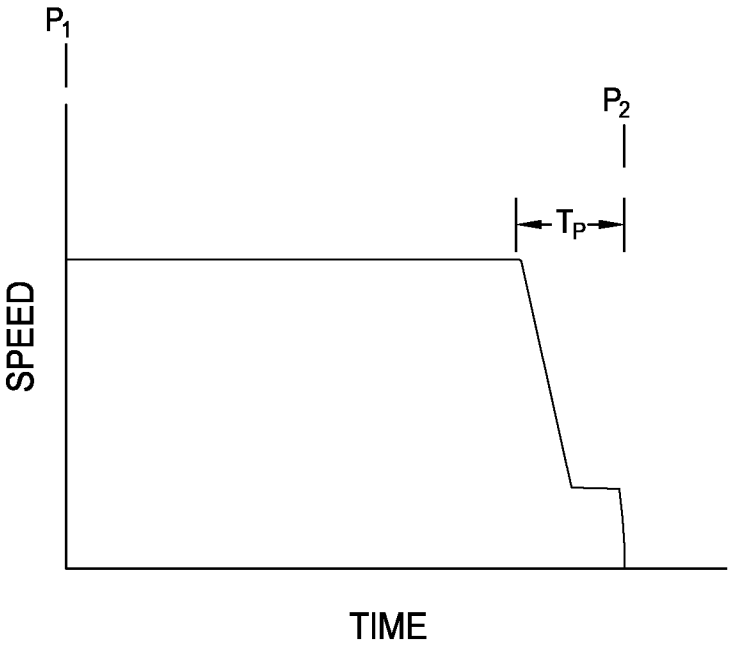
FIG. 12 is a graphical depiction of speed versus time as the covering system that is depicted in FIG. 1 is moved from the first, open position to the second, deployed position.

FIG. 12 is a graphical depiction of speed versus time, showing that the speed of deployment is reduced during the final positioning phase $T_P$.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A covering system, comprising:

a flexible, web-like membrane having first and second portions;

a first cross support connected to the first portion of the membrane;

a second cross support connected to the second portion of the membrane; and a drive mechanism for moving the second cross support relative to the first cross support so that the membrane is movable between a first, retracted position and a second, deployed position, and wherein the drive mechanism includes a force multiplication mechanism for facilitating a stress application to the membrane when in the second, deployed position wherein the force multiplication mechanism comprises a flexible drive member and a plurality of pulleys, and wherein the flexible drive member is configured to form more than one loop, thereby creating a force multiplication effect.

2. A covering system according to claim 1, wherein the flexible drive member comprises a flexible belt.

3. A covering system according to claim 2, wherein the flexible belt has a plurality of teeth formed therein, and wherein at least one of the pulleys has at least one mating tooth formed therein.

4. A covering system according to claim 1, wherein the drive mechanism further comprises an elongated drive beam and a trolley member that is mounted for movement with respect to the elongated drive beam.

5. A covering system according to claim 4, wherein the elongated drive beam has an interior space defined therein, and wherein the force multiplication mechanism is positioned within the interior space.

6. A covering system according to claim 4, wherein the first cross support is mounted for movement together with one of the elongated drive beam and trolley member, and wherein the second cross support is mounted for movement together with the other of the elongated drive beam and trolley member.

7. A covering system according to claim 4, wherein the elongated drive beam has a longitudinal axis, and wherein the drive mechanism is constructed and arranged to move the membrane between the first, refracted position and the second, deployed position in a direction that is substantially parallel to the longitudinal axis.

8. A covering system according to claim 4, wherein the elongated drive beam extends substantially along a first axis and wherein at least one of the first and second cross supports extend along a second axis that is substantially perpendicular to the first axis.

9. A covering system according to claim 8, wherein the first cross support is oriented so as to be substantially parallel to the second cross support.

10. A covering system according to claim 1, further comprising a control system for controlling the drive mechanism, and wherein the control system is constructed and arranged to instruct the drive mechanism to create a tension stress in the web-like membrane when the web-like membrane approaches the second, deployed position.

11. A covering system according to claim 10, wherein the control system monitors an amount of force that is applied through the drive mechanism to create a tension stress in the web-like membrane.

12. A covering system according to claim 10, wherein the drive mechanism is constructed and arranged to prestress the web-like membrane so as to create a tension in the web-like membrane that has a longitudinal component.

13. A covering system according to claim 12, further comprising a transverse tensioning mechanism that is constructed and arranged to create a tension in the web-like membrane that is substantially transverse to the tension that has a longitudinal component.

14. A covering system according to claim 13, wherein the transverse tensioning mechanism comprises a catenary linkage that is constructed and arranged to create a transverse tension in response to the tension that has the longitudinal component.

15. A covering system according to claim 14, further comprising at least one additional cross support that is oriented so as to be substantially parallel to the first and second cross supports.

16. A covering system according to claim 10, wherein the control system is constructed and arranged to monitor a position of the drive mechanism.

17. A covering system according to claim 1, further comprising a brake for securing the drive mechanism in a locked position when the web-like membrane is in the second, deployed position.

18. A covering system according to claim 1, wherein the web-like membrane has an area that is substantially at least about 500 $ft.^2$.

19. A covering system, comprising:

a flexible, web-like membrane having first and second portions;

a first cross support connected to the first portion of the membrane;

a second cross support connected to the second portion of the membrane;

a drive mechanism for moving the second cross support relative to the first cross support so that the membrane is movable in a first direction having a longitudinal component between a first, refracted position and a second, deployed position in which the membrane is tensioned in the first direction; and a transverse tensioning mechanism that is separate from the drive mechanism constructed and arranged to create a tension in the web-like membrane that is substantially transverse to the first direction.

20. A covering system according to claim 19, wherein the transverse tensioning mechanism comprises a catenary linkage that is constructed and arranged to create a transverse tension in response to the tension that has the longitudinal component.

21. A covering system according to claim 20, further comprising at least one additional cross support, and wherein the catenary linkage comprises a flexible member that is connected to more than one of the cross supports.

22. A covering system according to claim 21, wherein the flexible member is mounted to respective distal ends of at least two of the cross supports.

23. A covering system according to claim 21, wherein the flexible member comprises a cable.

24. A covering system according to claim 21, wherein the flexible member is attached to the web-like membrane.

25. A covering system according to claim 19, wherein the drive mechanism includes a force multiplication mechanism for facilitating tensioning of the membrane when in the second, deployed position.

26. A covering system according to claim 19, wherein the web-like membrane has an area that is substantially at least about 500 $ft.^2$.

* * * * *